US007011028B1

(12) United States Patent
Emary

(10) Patent No.: US 7,011,028 B1
(45) Date of Patent: Mar. 14, 2006

(54) RIMFIRE CARTRIDGE FOR A FIREARM

(75) Inventor: David E. Emary, St. Paul, NE (US)

(73) Assignee: Hornady Manufacturing Company, Grand Island, NE (US)

( * ) Notice: Subject to any disclaimer, the term of this patent is extended or adjusted under 35 U.S.C. 154(b) by 100 days.

(21) Appl. No.: 10/430,729

(22) Filed: May 6, 2003

(51) Int. Cl.
*F42B 5/32* (2006.01)

(52) U.S. Cl. ..... 102/464; 86/19.5

(58) Field of Classification Search ..... 102/430, 102/439, 464, 468, 469, 470; 86/19.5, 19.6
See application file for complete search history.

(56) References Cited

U.S. PATENT DOCUMENTS

| | | | | | |
|---|---|---|---|---|---|
| 2,371,716 | A * | 3/1945 | Snell | 86/19.5 |
| 2,397,370 | A * | 3/1946 | Raven et al. | 86/19.5 |
| 2,442,841 | A * | 6/1948 | Catlin et al. | 86/19.5 |
| 3,614,816 | A * | 10/1971 | Weyhmuller et al. | 86/19.5 |
| 4,041,868 | A * | 8/1977 | Rayle et al. | 102/468 |
| 5,535,678 | A * | 7/1996 | Brown | 102/439 |
| 6,192,561 | B1 * | 2/2001 | Bennett | 86/19.5 |

OTHER PUBLICATIONS

"History of the .22 Rimfires", Jun. 10, 1999, Internet published, pp. 1 & 2.*
"The RCBS.Load Cartridge Designer Utility", Apr. 30, 2001, Internet published, pp. 1-4.*
"The .22 Ammunition Trials", by V-Shrake, Mar. 21, 2003, Internet published, pp. 1-7.*
Advertisement: Aguila® New Products R&D, 17 Aguila.
Product Brochure: CCI® Rimfire Ammunition.

* cited by examiner

*Primary Examiner*—Michael J. Carone
*Assistant Examiner*—James S. Bergin
(74) *Attorney, Agent, or Firm*—Langlotz Patent Works, Inc.; Bennet K. Langlotz

(57) ABSTRACT

A firearm cartridge with a rimmed metal case having a body portion having a rim and a cylindrical wall portion adjacent to the rim. The body portion has dimensions corresponding to a 22 Long Rifle specification. The case has a tapered shoulder portion contiguous with the first portion, and a neck portion contiguous with the shoulder portion and a defining a mouth. The mouth closely receives a bullet having a diameter less than .22 caliber, and the case has a length significantly greater than 0.66 inch. The case may be formed with a neck that is relatively short compared to the body portion and overall length, to provide improved cartridge trajectory performance.

12 Claims, 1 Drawing Sheet

RIMFIRE CARTRIDGE FOR A FIREARM

FIELD OF THE INVENTION

This invention relates to firearms ammunition, and more particularly to rimfire cartridges having bottle-necked cases.

BACKGROUND AND SUMMARY OF THE INVENTION

Standard firearms cartridge cases have historically been modified to create new or improved cartridges. To avoid the tooling costs associated with manufacturing a new case, individual hobbyists and moderate-scale manufacturers will start with a widely available "parent" case, and form it to the desired dimensions. While this has been effective in many instances, there are narrow limitations on the amount of modification that a case can undergo. Therefore, the new case's dimensions are largely dependent on the parent case from which it is formed.

One cartridge formed in this manner is the 17 Aguila, produced by Industrias Tecnos, S.A. de C.V., of Mexico. The 17 Aguila is based on a conventional 22 Long Rifle (LR) case, which serves as the parent. Production of the 22 LR is believed to be in greater volume than any other cartridge or case, and is produced at a very low cost per unit, due to the high volume of manufacturing. This makes it desirable as a parent cartridge, as it affords the manufacturer of a new cartridge adequate margin for the cost of forming it into a new cartridge specification.

The 17 Aguila is a bottle-necked or shouldered version of the 22 LR, with the open end portion of the case necked down to form a reduced-diameter case mouth sized to receive a .17 caliber bullet. This is intended to provide a higher velocity than the 22 LR due to the lower bullet weight, with a higher sectional density providing a higher ballistic coefficient yielding a flatter trajectory. While somewhat effective, necking down the case reduces its volume, which limits the quantity of gun powder propellant that may be used. This limits the projectile velocity for a given projectile mass, which limits the effective range of the cartridge.

In commercial production of modified cases, modifications are limited to diameter reductions by necking down the portion at the case mouth, and length reductions by trimming. In low volumes, individual hobbyists may "fire form" centerfire cases (i.e. those having replaceable primers) by shooting a live parent cartridge in a firearm with a chamber sized for the desired new slightly larger case dimensions. This expands the case outward to provide a larger case volume, by reducing the taper of the case wall, or by moving forward and/or sharpening the angle of the shoulder of a bottlenecked cartridge. However, even if this were practical and economical for manufacturing volumes, it would be incompatible with rimfire cases, which are not reusable due to the lack of a replaceable primer, which is spent upon first use.

Consequently, because of the inherent limitations on case forming, the volume of the ubiquitous 22 LR case can not readily be increased in diameter or length to provide increased volume. The performance of .17 caliber cartridges based on 22 LR cases is therefore limited, and manufacturers have avoided utilizing alternative rimfire cases having larger case volumes due to their much lower production volume and therefore prohibitively high cost.

The present invention overcomes the limitations of the prior art by providing a firearm cartridge with a rimmed metal case having a body portion having a rim and a cylindrical wall portion adjacent to the rim. The body portion has dimensions corresponding to a 22 Long Rifle specification. The case has a tapered shoulder portion contiguous with the first portion, and a neck portion contiguous with the shoulder portion and a defining a mouth. The mouth tightly receives a bullet having a diameter less than .22 caliber, and the case has a length significantly greater than the 0.66 inch length of a conventional 22 LR. The case may be formed with a neck that is relatively short compared to the body portion and overall length, to provide improved cartridge performance.

DETAILED DESCRIPTION OF A PREFERRED EMBODIMENT

Figure 1:
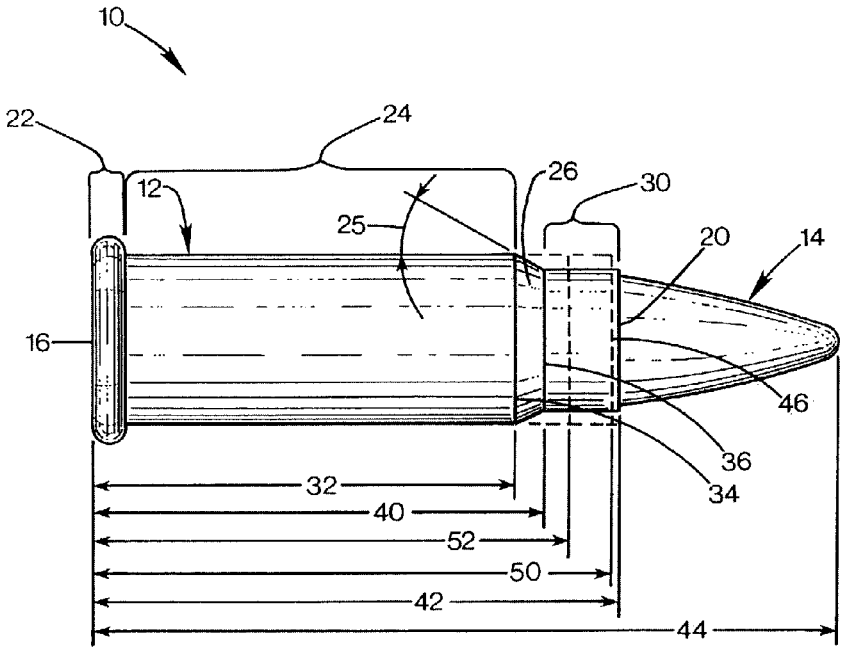
FIG. 1 is a side view of a rimfire cartridge according to a preferred embodiment of the invention.

FIG. 1 shows a rimfire cartridge 10 according to a preferred embodiment of the invention. The cartridge includes a case 12 and a bullet 14. The case is a generally hollow cylindrical body, preferably formed of brass, and has a bottleneck shape. The case has a head end 16 and a mouth end 20. The case has a rim 22 that protrudes circumferentially from the case at the base end. A generally cylindrical body portion 24 extends from the rim to a frustoconical shoulder 26 that tapers down from the body portion diameter to a neck 30, which is a cylindrical portion that extends to form the open mouth 20 at its free end.

The case defines an interior volume, so that it may contain a propellant charge of gun powder. The case interior includes a space within the rim, such that a primer compound within the rim is readily detonated by a firing pin impacting on the rim to impulsively pinch the rim against a firearm chamber face against which the rim rests.

The case has nominal dimensions intended to establish a standard cartridge type. Variations from the nominal dimensions are tolerated by limited amounts. All diameters have a tolerance of +0.000/−0.004 inch, except as otherwise noted. The rim has a nominal thickness in the tolerated range of 0.036 to 0.043 inch. The body portion 24 has a nominal diameter of 0.226 inch, which is nominally cylindrical, but which may have a minimal taper due to manufacturing processes. The body portion has a length 32 to the junction 34 with the shoulder (measured from the head face, including the rim thickness) of 0.5710 inch.

The shoulder has an axial length of 0.0386 inch, and a taper angle (indicated as 25) of 25 degrees. The junction 36 between the shoulder 26 and the neck 30 is thus 0.6096 inch (indicated as length 40) from the head face 16. The neck has a nominal length of 0.1004 inch, although given the acceptable dimensional tolerances, this may be expressed as 0.100 inch. The case's overall length 42 is in the tolerated range of 0.702 to 0.710 inch.

The case neck has an outside diameter of 0.190 inch. The case mouth receives a .172 caliber bullet, preferably a 17 grain copper-clad bullet with a spitzer profile to provide a relatively high ballistic coefficient for flat long range trajectory. With the bullet seated, the cartridge has a nominal overall length 44 of between 0.965 and 1.000 inch.

In contrast, the prior art "17 Aguila" cartridge has a length 32 of 0.487 inch, a length 40 of 0.5256, an overall case length 42 of 0.657 inch. The prior art cartridge has the same overall length of 1.000 inch. Thus, the preferred embodiment has increased case volume, without increasing overall length. This avoids the need for a rifle receiver with a greater overall length. Moreover, an existing rifle chambered for the 17 Aguila may be readily modified to accept the preferred embodiment cartridge simply by reaming the chamber to move forward the portions of the chamber that correspond to the shoulder and case mouth.

The rim and body diameter dimensions are consistent with a conventional 22 Long Rifle cartridge. However, the shoulder and neck portions deviate from a standard 22 LR in the preferred embodiment as in the above prior art configuration. The preferred embodiment differs significantly from the prior art in terms of case length, and significantly exceeds the overall length of the commonly-produced 22 LR case.

The preferred embodiment is formed from a straight-walled parent 22 LR rimfire case 46 (shown in dashed lines) having the same diameter as the body portion throughout its length to the mouth. The parent case has a length 50 of 0.700 inch. The parent case is modified by conventional cartridge case brass forming methods, in which the parent case mouth is forced into a neck die sized generally in the form of the desired finished case shoulder and neck. The finished case dimensions are established to comply with the inherent case lengthening that occurs during the necking operation of a selected parent case length, so that the case need not be trimmed to length in an additional manufacturing step. In the preferred embodiment, the parent case is the same as that used for the Stinger® cartridge, which is a 22 LR cartridge having an extended case, and which is produced by CCI, a subsidiary of Alliant TechSystems, Inc. (ATK) of Edina Minn.

In the preferred embodiment, the formation of the neck causes a case lengthening of 0.010 inch, as the case diameter at the neck is reduced by about 0.036 inch. Thus, the case has lengthened by about 28% of the amount by which the mouth diameter has been reduced. This slight lengthening is considered "insignificant" for purposes of this application, and the important and "significant" length difference between the preferred embodiment parent case (and finished case) and the 0.640 inch-long (reference number 52) conventional 22 LR case (and its slightly longer 17 Aguila finished case.) Length differences that are accounted for by tolerance variations and case lengthening during necking are insignificant, but the length difference between the preferred embodiment and the prior art is significant.

As the parent case is already primed, the cartridge manufacturing proceeds after case formation by filling the case with a propellant charge, and inserting and securing a bullet.

The preferred embodiment case differs from that of the above-noted prior art in that the neck length is relatively short compared to the overall cartridge length and to the body portion length. In addition, the body portion is relatively long compared to the overall length.

| | Preferred embodiment | Prior art (17 Aguila) |
|---|---|---|
| Overall case length | 0.710 inch | 0.657 inch |
| Overall cartridge length | 1.000 inch | 1.000 inch |
| Body length (including rim) | 0.571 inch | 0.487 inch |
| Neck length | 0.100 inch | 0.131 inch |
| Neck/overall (case) ratio | 0.141 | 0.199 |
| Neck/body ratio | 0.175 | 0.269 |
| Overall (case)/body ratio | 1.243 | 1.349 |
| Overall (cart.)/body ratio | 1.751 | 2.053 |
| Case volume (grams $H_2O$) | 5.4 | 4.3 |

In each of the four ratios listed in the above table, the preferred embodiment's smaller number provides improved cartridge performance for a given cartridge or case length. The use of a longer parent case that deviates from the common and widely available 22 LR case provides more case volume to provide better performance. In addition, even for a given case length, the use of a shorter neck provides a larger portion of the case to be devoted to the powder-containing body portion, further improving performance.

The performance advantages and differences from the prior art are listed below:

| Cartridge | Bullet Wt. (grains) | Muzzle Velocity | Muzzle energy (ft-lb) |
|---|---|---|---|
| Preferred Embodiment | 40 | 1255 | 140 |
| 17 Aguila | 20 | 1830 | 149 |
| 22 LR | 17 | 2200 | 183 |

While the above is discussed in terms of preferred and alternative embodiments, the invention is not intended to be so limited.

What is claimed is:

1. A firearm cartridge comprising:

a rimmed metal case having a body portion comprising a rim and a cylindrical wall portion adjacent to the rim;

the rim having a thickness in the range of 0.036 to 0.043 inch;

the cylindrical wall portion having a diameter in the range of 0.222 to 0.226 inch;

the case having a tapered shoulder portion contiguous with the body portion;

a neck portion contiguous with the shoulder portion and a defining a mouth;

the mouth closely receiving a bullet having a diameter less than .22 caliber;

the case having a length greater than 0.66 inch; and wherein the case has a length of at least 0.702 inch, the body portion has a length of at least 0.56 inch including the rim thickness, the shoulder portion is a frustoconical surface, and the neck portion has an outside diameter of 0.19 inch and a length of 0.100.

2. The cartridge of claim 1 wherein the body portion of the case has a length of 0.571 inch.

3. The cartridge of claim 1 wherein the cartridge has an overall length of 1.0 inch.

4. The cartridge of claim 1 wherein the bullet is .172 caliber.

5. The cartridge of claim 1 wherein the cartridge is a rimfire cartridge.

6. A metal case for a firearm cartridge comprising:

a body portion comprising a rim and a cylindrical wall portion adjacent to the rim;

the rim having a thickness in the range of 0.036 to 0.043 inch;

the cylindrical wall portion having a diameter in the range of 0.222 to 0.226 inch;

the case having a shoulder portion contiguous with the body portion;

the shoulder portion tapering to a contiguous neck portion defining a mouth;

the mouth having an interior diameter sized to closely receive a bullet having a diameter less than a .22 caliber; and wherein the case has a length of at least 0.702 inch, the body portion has a length of at least 0.55 inch including the rim thickness, the shoulder portion is a frustoconical surface, and the neck portion has an outside diameter of 0.19 inch and a length of 0.100.

7. The case of claim 6 wherein the body portion of the case has a length of 0.571 inch.

8. The case of claim 6 wherein the case is for a rimfire cartridge.

9. A rimfire firearm cartridge comprising:

a rimmed metal case having a body portion comprising a rim and a cylindrical wall portion adjacent to the rim;

the rim having a thickness in the range of 0.036 to 0.043 inch;

the cylindrical wall portion having a diameter in the range of 0.222 to 0.226 inch;

the case having a tapered shoulder portion contiguous with the body portion;

a neck portion contiguous with the shoulder portion and a defining a mouth;

the mouth closely receiving a bullet having a diameter less than .22 caliber;

the case having a length of at least 0.702 inch;

the body portion having a length of at least 0.56 inch including the rim thickness; and the neck portion having an outside diameter of 0.19 inch and a length of 0.100.

10. The cartridge of claim 9 wherein the cartridge has an overall length of 1.0 inch.

11. The cartridge of claim 9 wherein the body portion of the case has a length of 0.571 inch.

12. The cartridge of claim 9 wherein the bullet is .172 caliber.

* * * * *